US008786497B2

(12) United States Patent
Sharawi

(10) Patent No.: US 8,786,497 B2
(45) Date of Patent: Jul. 22, 2014

(54) HIGH ISOLATION MULTIBAND MIMO ANTENNA SYSTEM

(75) Inventor: Mohammad S. Sharawi, Dhahran (SA)

(73) Assignee: King Fahd University of Petroleum and Minerals, Dhahran (SA)

( * ) Notice: Subject to any disclaimer, the term of this patent is extended or adjusted under 35 U.S.C. 154(b) by 847 days.

(21) Appl. No.: 12/958,330

(22) Filed: Dec. 1, 2010

(65) Prior Publication Data

US 2012/0139793 A1 Jun. 7, 2012

(51) Int. Cl.
*H01Q 1/38* (2006.01)
*H01Q 5/01* (2006.01)
*H01Q 21/30* (2006.01)

(52) U.S. Cl.
USPC ..... 343/700 MS; 343/828; 343/846

(58) Field of Classification Search
USPC ..... 343/700 MS, 702, 828, 829, 841, 846, 343/895
See application file for complete search history.

(56) References Cited

U.S. PATENT DOCUMENTS

| | | | | |
|---|---|---|---|---|
| 4,460,894 | A * | 7/1984 | Robin et al. | 343/700 MS |
| 4,783,661 | A * | 11/1988 | Smith | 343/700 MS |
| 5,898,404 | A * | 4/1999 | Jou | 343/700 MS |
| 5,949,383 | A | 9/1999 | Hayes et al. | |
| 6,218,989 | B1 * | 4/2001 | Schneider et al. | 343/700 MS |
| 6,476,767 | B2 * | 11/2002 | Aoyama et al. | 343/700 MS |
| 7,405,699 | B2 | 7/2008 | Qin | |
| 7,411,554 | B2 | 8/2008 | Jung et al. | |
| 7,586,445 | B2 | 9/2009 | Qin et al. | |
| 7,639,185 | B2 | 12/2009 | Mei | |
| 2003/0034917 | A1 | 2/2003 | Nishizawa et al. | |
| 2009/0009400 | A1 | 1/2009 | Kim et al. | |

* cited by examiner

*Primary Examiner* — Michael C Wimer
(74) *Attorney, Agent, or Firm* — Richard C. Litman

(57) ABSTRACT

The high isolation multiband MIMO antenna system is a multi-band dual and quad antenna for multiple-input-multiple-output (MIMO) antenna systems. Element and ground plane geometries that can cover a wide range of frequency bands (780 MHz-5850 MHz) are based on the varying some simple geometrical lengths and widths of the elements and ground planes. The MIMO antenna systems can be used for next generation cellular and wireless MIMO communication systems. Several isolation enhancement schemes increase the isolation between adjacent antenna elements. Any combination of the isolation and MIMO antenna system geometries can be created to support different wireless system standards. The novel MIMO antenna systems are disposed within a dielectric substrate area of 50×100 mm$^2$.

15 Claims, 11 Drawing Sheets

HIGH ISOLATION MULTIBAND MIMO ANTENNA SYSTEM

BACKGROUND OF THE INVENTION

1. Field of the Invention

The present invention relates to antennas for multiple-input multiple-output (MIMO) wireless communications, particularly of the microstrip antenna type used, e.g., in handsets for mobile or cellular telephones, and more particularly to a high isolation multiband MIMO antenna system.

2. Description of the Related Art

The next generation of wireless systems will be capable of providing high throughputs, broader bandwidths, and better interference mitigation, thus providing multimedia services with peak data rates of more than 150 Mbps in the downlink and 50 Mbps in the uplinks. One of the key enabling technologies in such systems is the utilization of multiple-input-multiple-output (MIMO) antenna systems.

MIMO antenna systems have a group of antennas in the transmitter and receiver terminals of the wireless system. This will allow the communication system to achieve higher data rates, and thus provide better multimedia service. One of the major design challenges in MIMO antenna system design is its miniaturization and integration issues, especially in the small form factor user terminals (or handheld devices). Also, when integrating several antennas in a small area, the coupling between them increases, their diversity performance decreases, and thus the efficiency of the wireless communication system decreases so that high data rates are no longer achievable.

The new cellular and wireless systems are leaning towards the lower frequency bands of operation because of the extended coverage area and better in-building penetration of the electromagnetic waves. The antenna design for lower operating bands is a challenge by itself, since the antenna size is expected to be larger in size than the ones used in higher frequency bands (a fundamental law in electromagnetic theory).

Thus, a multiband multiple-input and multiple-output (MIMO) antenna system with improved isolation solving the aforementioned problems is desired.

SUMMARY OF THE INVENTION

The high isolation multiband MIMO antenna system includes several antenna geometries that will operate at much lower frequency bands than traditional designs known in the art, and thus cover a wide range of wireless standards, especially for the fourth generation cellular phone system and the next generation in wireless data networks (as well as any variations of the two where multiple operating frequencies and MIMO system operation is to be supported). The high isolation multiband MIMO antenna system includes antennas that cover from 800 MHz up to 5.8 GHz, based upon the parameters used (higher frequency bands are also supported, but no commercial applications exist at this time). Each MIMO antenna system can comprise two elements, four elements, or more elements, depending upon the standard covered and the area provided within the device, and thus cover at least three different bands of operation that can be as wide as from 800 MHz to 5.8 GHz.

The high isolation multiband MIMO antenna system relates to microstrip antennas that have a single sheet of dielectric material with strips of copper-clad material forming antenna radiating/receiving elements and strips of copper-clad material forming ground planes on opposite sides of the dielectric material in patterns that are shaped and configured in relation to one another in such a manner that coupling between the different antennas is reduced to improve diversity and maximize data throughput. The antennas are dimensioned and configured so that they may be used, e.g., in the handsets of mobile or portable radios or cellular telephones, or similar handheld MIMO devices.

In addition to the various geometries of the antennas, we propose several schemes to enhance the isolation between the adjacent antenna elements within the MIMO antenna system. This is done via a variety of techniques on the first and second sides of the substrate where the reference plane (ground plane) can be situated. All the geometries and isolation enhancement methods are confined to a very small area of $100\times50$ mm$^2$, which is a typical size of a handheld device. This can be expanded to include more than four MIMO antennas if the size of the terminal allows that, and if the standard supports multiple elements on the user terminal side.

These and other features of the present invention will become readily apparent upon further review of the following specification and drawings.

BRIEF DESCRIPTION OF THE DRAWINGS

FIG. 3C shows a plan view of still another alternative embodiment of a ground plane face of the dielectric substrate that can be used opposite the top face of FIG. 2A in a high isolation multiband MIMO antenna system according to the present invention.

Similar reference characters denote corresponding features consistently throughout the attached drawings.

DETAILED DESCRIPTION OF THE PREFERRED EMBODIMENTS

The high isolation multiband MIMO antenna system is exemplified by several different embodiments of MIMO antennas that are variations of microstrip antennas constructed of copper-clad strips on opposite faces of a dielectric substrate, such as a printed circuit board. The antennas are dimensioned and configured to fit within the housing of a handheld MIMO device, such as a mobile or portable radio or cellular telephone. Each embodiment is configured for communication on at least two different frequency bands, with each band having multiple transmit/receive antennas for MIMO wireless communication.

Figure 1:
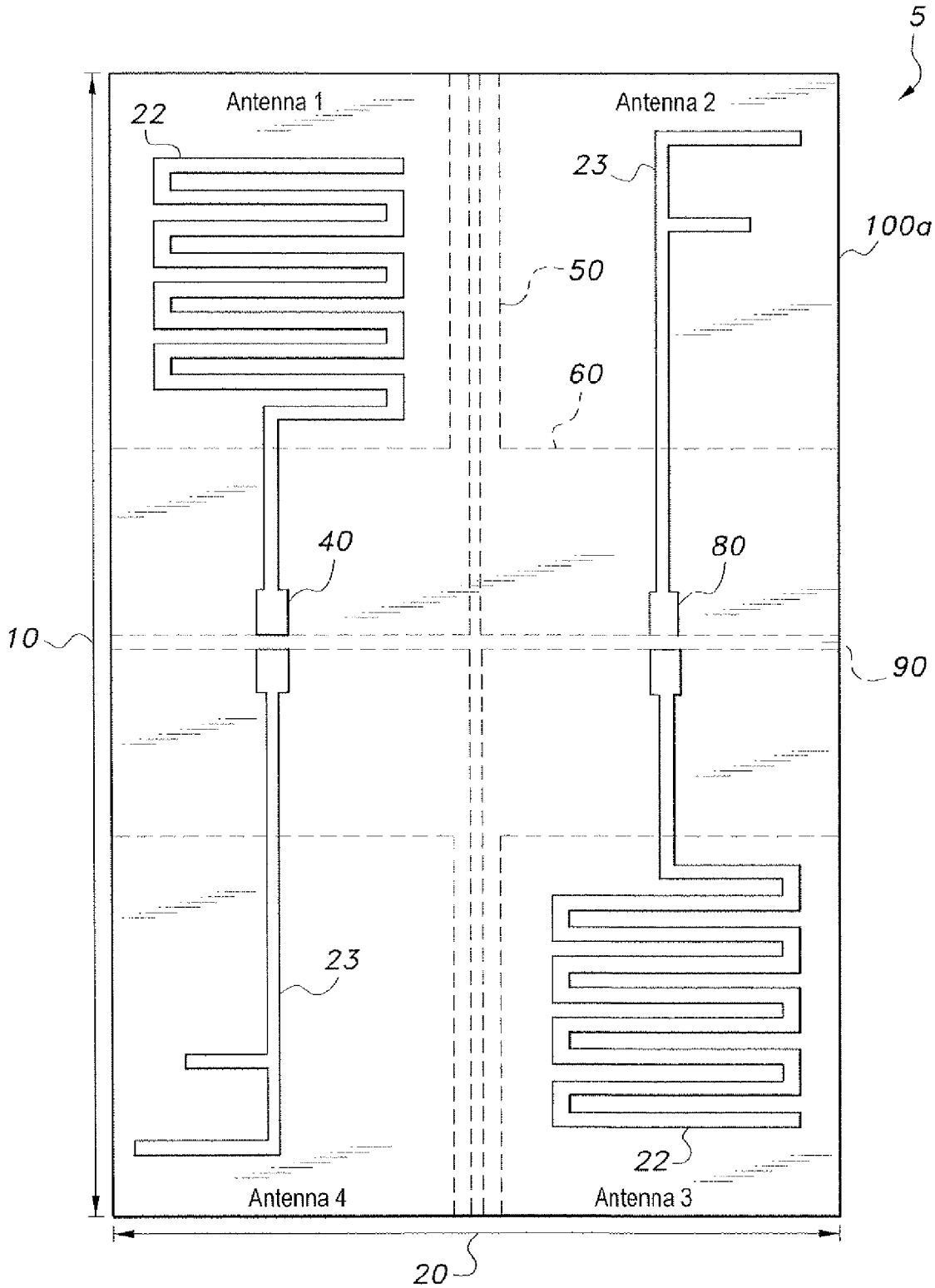
FIG. 1 is a top plan view of an exemplary high isolation multiband MIMO antenna system according to the present invention, the ground plane on the opposite face of the dielectric substrate being shown in phantom.

FIG. 1 shows an exemplary high isolation multiband MIMO antenna system 5 having four elements. The antennas of the system are printed on the top face 100*a* of a dielectric material substrate (sometimes referred to herein as an antenna board). The thickness of the substrate is preferably 0.8 mm, but other thicknesses can be used given that the thicknesses and lengths of the antenna elements are adjusted to cover the bands of frequencies needed. Two F-shaped antenna elements 23 and two serpentine-shaped antenna elements 22, are shown, where each two of the same type are printed in a diagonal way to reduce the coupling and thus increase the isolation, i.e., the F-shaped elements 23 are position in the upper right and lower left quadrants of the board 5, and the two serpentine elements 22 are positioned in the upper left and lower right quadrants of the board, respectively. The two different antenna geometries (serpentine 22 and F-shaped) 23 are placed beside one another, since each antenna operates in a different band, thus reducing interference on its adjacent element. The pattern of the antenna radiating/receiving elements are shown more clearly in FIG. 28, which shows the top face 100*a* of the board rotated 90° clockwise from its orientation in FIG. 1. The antennas are fed from feeding points 40 and 80 and are impedance-matched to the feeding cable or transmission line impedance.

Each antenna radiating/receiving element has a corresponding reference plane, i.e., a ground plane in its corresponding quadrant, each ground plane having a broad, rectangular central portion 60 disposed towards the middle of the board and a narrow elongate portion 50 or strip extending medially from the broad central portion 60 to the corresponding end of the board. There is a split portion 90 free of copper-clad tracing disposed between opposing elongate portions 50 and between opposing broad rectangular portions 60. The elongate portions 50 and broad rectangular portions 60 are a metal layer, while the split part 90 is non-metallic, meaning that there is a gap between the metal ground plane sections on the bottom face of the substrate, as shown most clearly in FIG. 2A, which shows the bottom face of the antenna board rotated 90° clockwise from the orientation of the antenna in FIG. 1.

The length and width of the dielectric substrate are shown as 10 and 20, respectively. For a typical smart phone device, the lengths 10 and 20 are typically given by 100×50 $mm^2$. The serpentine antenna elements 22 are tuned to operate in a low frequency band, as low as 780 MHz, with a bandwidth of at least 80 MHz. The "F" shaped antenna elements 23 can operate on two higher frequency bands by adjusting the lengths of the two arms of the letter F, and the operating frequency can be in the 1 GHz, 2 GHz or higher frequency bands and wireless standards. This can cover cellular phone operation (GSM, PCS), wireless local-area-networks (WLAN), Bluetooth, WiBro, WiMax, etc.

The extended ground plane arm 50 and the split 90 are utilized to increase the isolation between the antenna elements. A typical value of isolation between two adjacent and similar elements is approximately 13 dB. If two different elements are used, as in FIG. 1, the isolation is approximately a minimum of −15 dB.

Figure 2A:
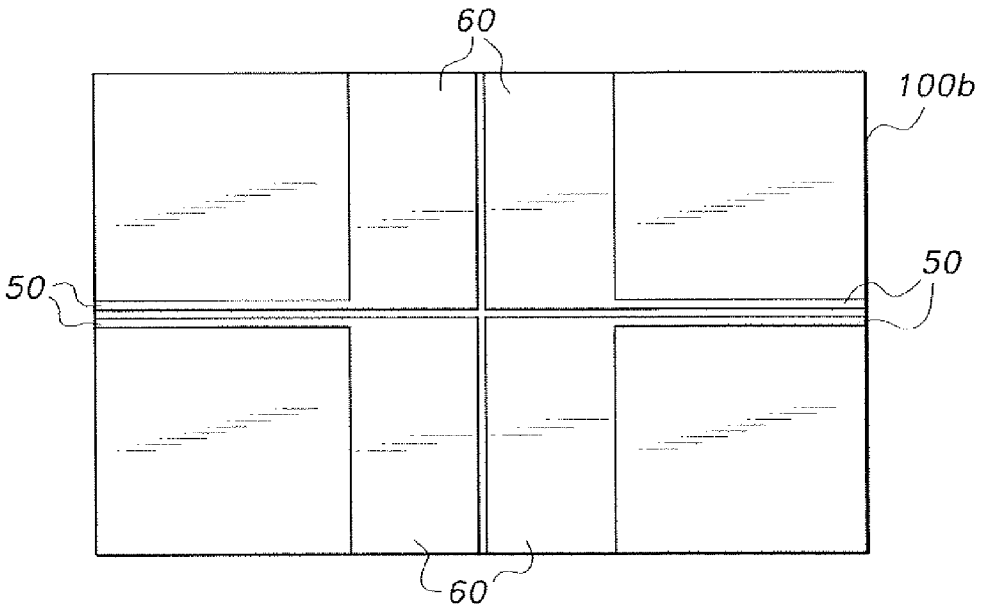
FIG. 2A is a bottom view of the antenna board or system of FIG. 1, shown rotated 90° clockwise from the orientation of FIG. 1.
Figure 2B:
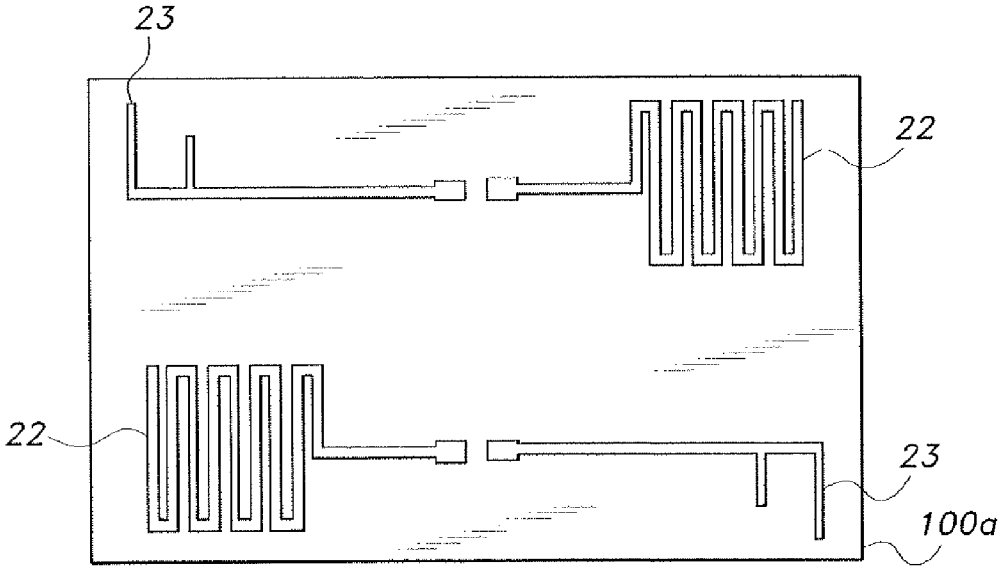
FIG. 2B is a top view of the antenna board or system of FIG. 1, shown rotated 90° clockwise from the orientation of FIG. 1.

The substrate bottom face 100*b* is most clearly shown in FIG. 2A. The substrate top face 100*a* is most clearly shown in FIG. 2B. The four exemplary top face antennas 22 and 23 are designed to cover at least three different operating frequencies of various wireless standards. The diagonally opposed zigzag (serpentine) antennas 22 are capable of covering the lower frequency bands around 780 MHz. The diagonally opposed F-shaped antenna elements 23 can cover two higher frequency bands. The two sets of opposing reference plane extended arms 50 enhance the isolation between adjacent elements. The split 90 in the reference plane provides an additional isolating feature. The main broad, rectangular reference plane portions 60 are also shown in FIG. 2A. Each antenna element, along with its ground plane, occupies approximately twenty-five percent of the total area of the substrate. In the embodiment shown, this gives a total area of 25×50 $mm^2$.

Figure 3A:
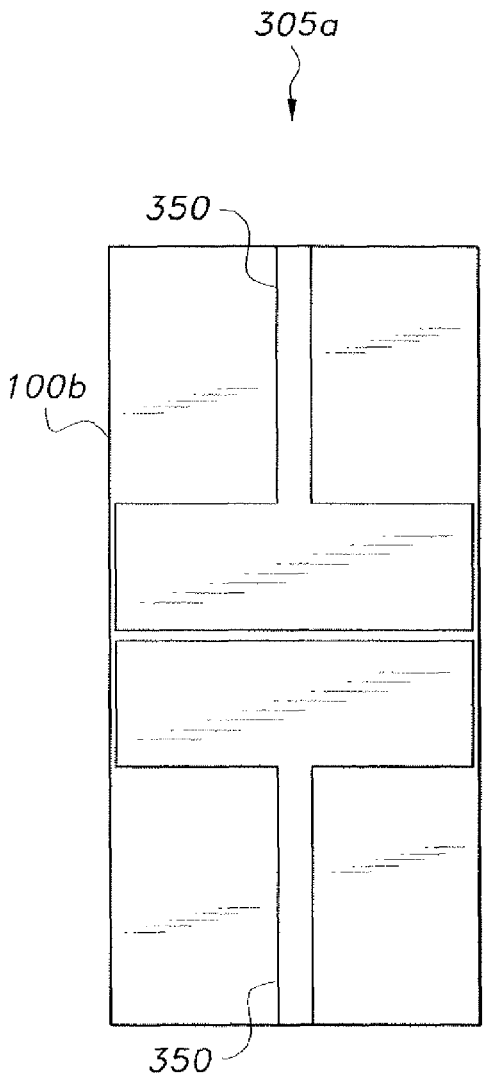
FIG. 3A shows a plan view of an alternative embodiment of a ground plane face of the dielectric substrate that can be used opposite the top face of FIG. 2A in a high isolation multiband MIMO antenna system according to the present invention.

This embodiment of a MIMO antenna 5 may have alternative ground plane geometries that can be used on the bottom face 100*b* of the dielectric substrate, as shown in FIGS. 3A through 3F. As shown in FIG. 3A, ground plane configuration 305*a* has a copper-clad major arm 350 in the middle of each reference plane, i.e., the two ground planes in the upper left and lower left quadrants of FIG. 2A have been merged together medially, and the two ground planes in the upper right and lower right quadrants of FIG. 2A have been merged together medially. In FIG. 3A, the upper left, lower left, upper right, and lower right corners and the center strip between the upper and lower halves of the dielectric substrate are unclad, leaving the dielectric substrate exposed to air. The geometry of this configuration 305*a* gives isolation for the worst case (two identical antenna elements adjacent to or beside one another) of −8 dB between adjacent antenna elements.

Figure 3B:
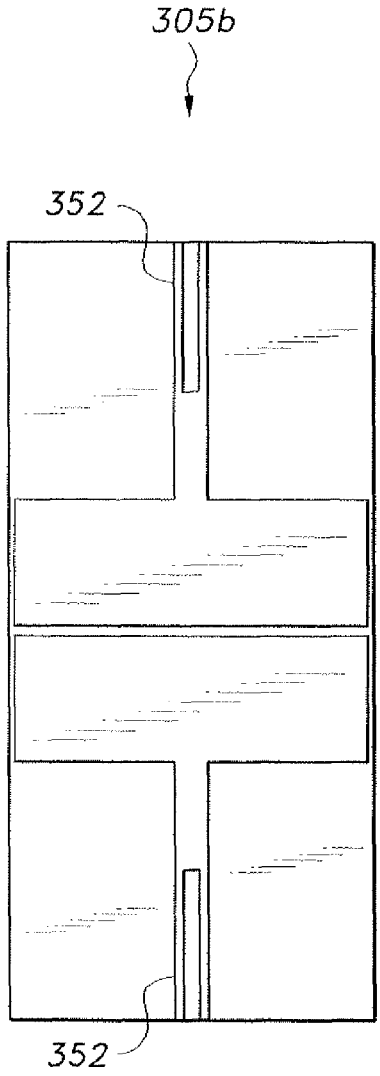
FIG. 3C shows a plan view of another alternative embodiment of a ground plane face of the dielectric substrate that can be used opposite the top face of FIG. 2A in a high isolation multiband MIMO antenna system according to the present invention.
FIG. 3D shows a plan view of yet another alternative embodiment of a ground plane face of the dielectric substrate that can be used opposite the top face of FIG. 2A in a high isolation multiband MIMO antenna system according to the present invention.
FIG. 3E shows a plan view of another alternative embodiment of a ground plane face of the dielectric substrate that can be used opposite the top face of FIG. 2A in a high isolation multiband MIMO antenna system according to the present invention.
FIG. 3F shows a plan view of yet another alternative embodiment of a ground plane face of the dielectric substrate that can be used opposite the top face of FIG. 2A in a high isolation multiband MIMO antenna system according to the present invention.
Figure 3C:
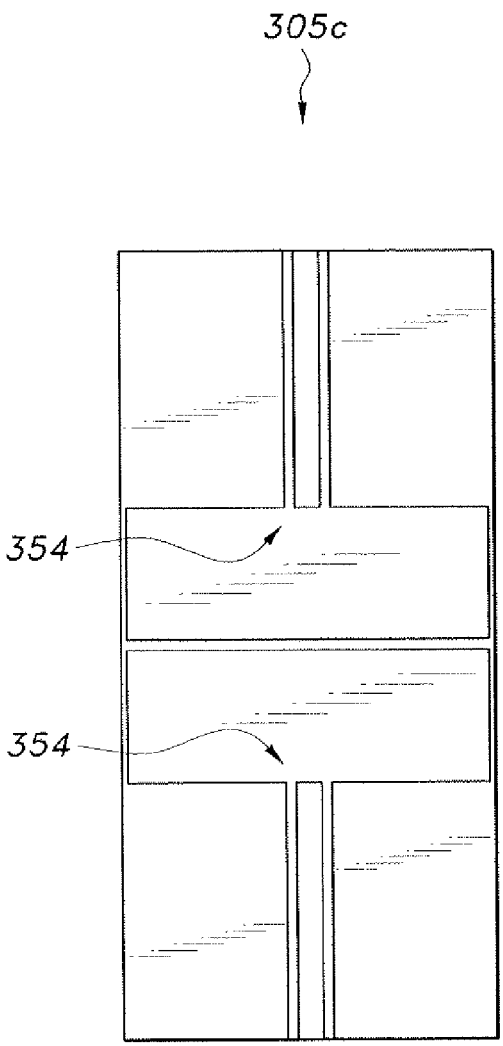

As shown in FIG. 3B, configuration 305*b* introduces an elongate split to define bifurcated major arms 352, which enhances the isolation by 2 dB. As shown in FIG. 3C, in configuration 305*c*, the split is lengthened to form bifurcated major arms 354 in which the furcations are separated from each other from the central ground plane patch to the end of the substrate, which adds about 2 dB to the isolation. When the split goes all the way through the central ground plane patches 60, as shown in FIG. 2A, the worse case isolation obtained will be around −13 dB.

Figure 3D:
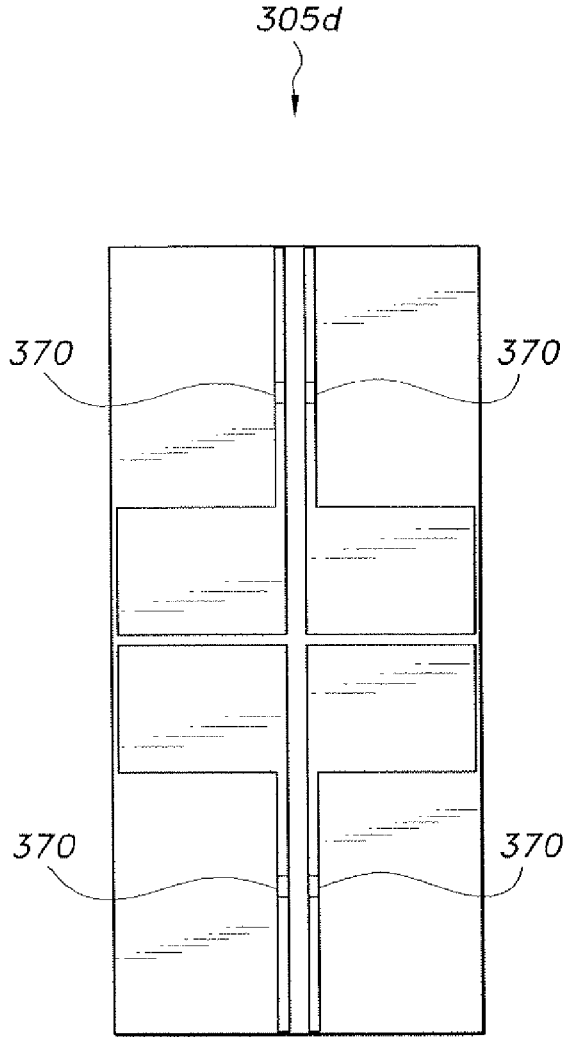
Figure 3E:
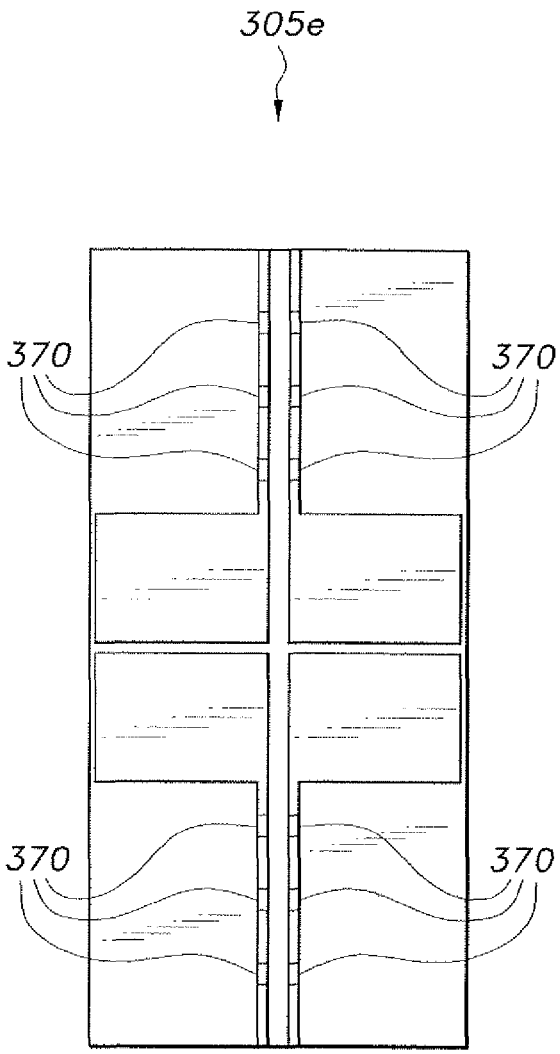

As shown in FIG. 3D, in configuration 305*d*, the pattern of the ground planes is similar to FIG. 2A, but a gap 370 that is about 1 mm in size breaks each of the arms of the reference or ground plane. This gap 370 enhances the isolation by approximately 1 to 2 dB. FIG. 3E shows a configuration 305*e* similar to FIG. 3D, but two more gaps 370 are disposed in the middle of each arm to enhance isolation by yet an additional 1 to 2 dB. Thus, a total isolation enhancement of approximately 4 dB greater than the original ground plane configuration is achieved via the additional splits 370. The total isolation between any two adjacent elements in the worse case will be on the order of −16 to −19 dB. This is a good performance metric in MIMO antenna systems that are confined to a very small area (in the device housing) and that cover very wide frequency ranges.

The antenna configurations described herein are able to cover a much lower frequency band (780 MHz) that will be fundamental in next generation wireless systems than conventional antennas. All geometries are printed on a dielectric substrate area of 100×50 $mm^2$.

Figure 3F:
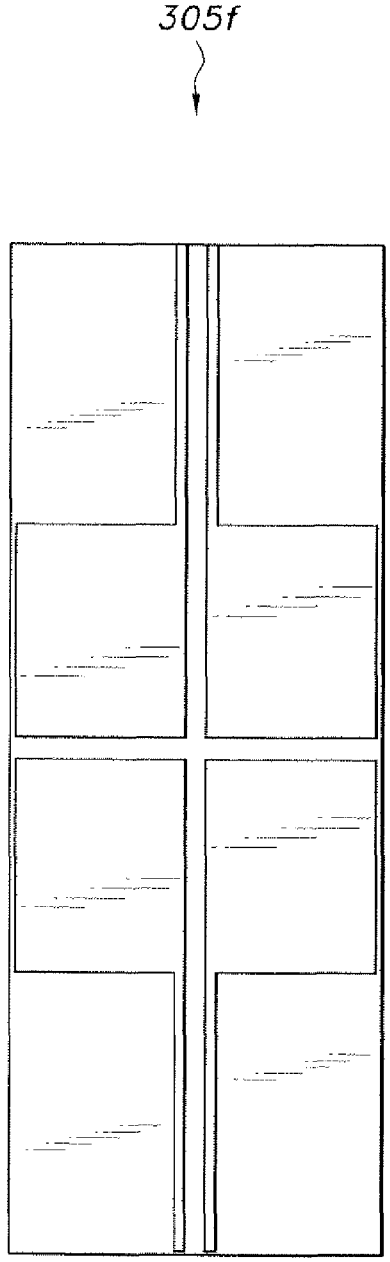

As shown in FIG. 3F, the split divides the ground plane into a four quadrant pattern 305*f* of identical broad rectangular and narrow elongate ground planes. A slight improvement of about −1 dB in the 780 MHz frequency band was observed, but a much larger isolation enhancement was observed at higher frequency bands. Also, the isolation curve was much cleaner from ripple and showed much lower isolation values.

Figure 4A:
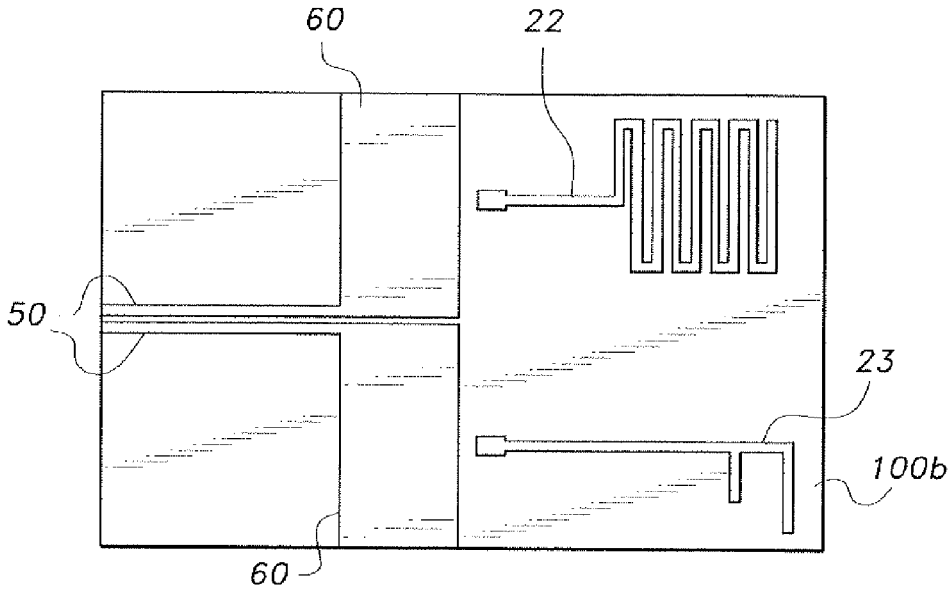
FIG. 4A is a plan view showing the bottom face of an alternative embodiment of an antenna board in a high isolation multiband MIMO antenna system according to the present invention.
Figure 4B:
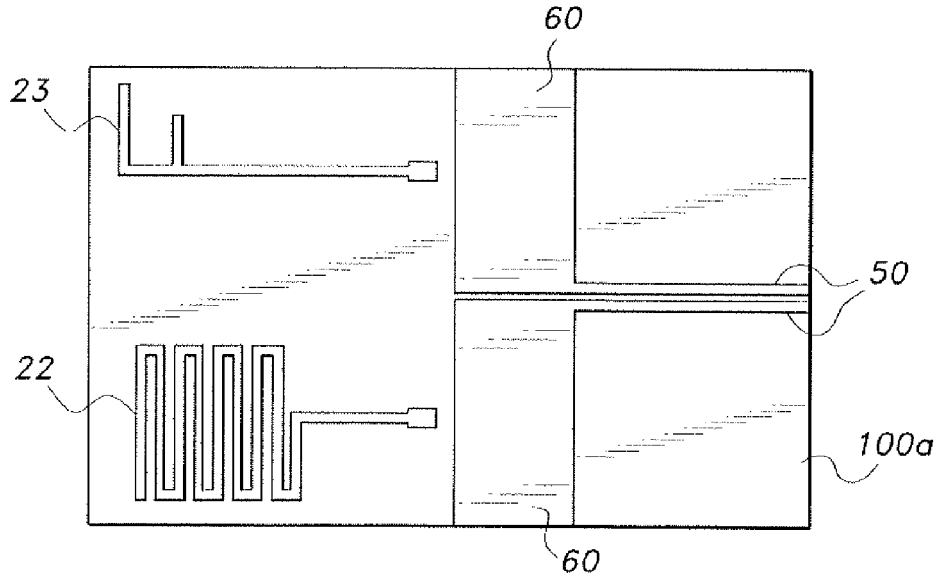
FIG. 4B is a plan view showing the top face of the antenna board of FIG. 4A.

In the alternative embodiment shown in FIGS. 4A and 4B, the antennas and reference planes are split between the top face 100*a* of the dielectric substrate and the bottom face 100*b* of the dielectric substrate. The bottom face 100*b* (shown in FIG. 4A) has a serpentine antenna element 22 in the upper right quadrant, an F-shaped antenna element 23 in the lower right quadrant, and two reference planes, one in the upper left quadrant and one in the lower right quadrant, each of the reference planes having a broad, substantially rectangular central portion 60 and an elongate portion 50 or strip extending medially from the central portion 60 to the left end of the substrate. The top face 100*a* (shown in FIG. 4B) includes an F-shaped antenna element 23 in the upper left quadrant and a serpentine antenna element 22 in the lower left quadrant of the top face 100*a*.

Reference planes are oriented in the upper right and lower right quadrants of the top face 100*a*. This alternation between the two faces 100*a* and 100*b* reduces antenna coupling, and thus enhances isolation between the antenna elements. The dimensions of this configuration are also 50×100 $mm^2$.

Figure 5A:
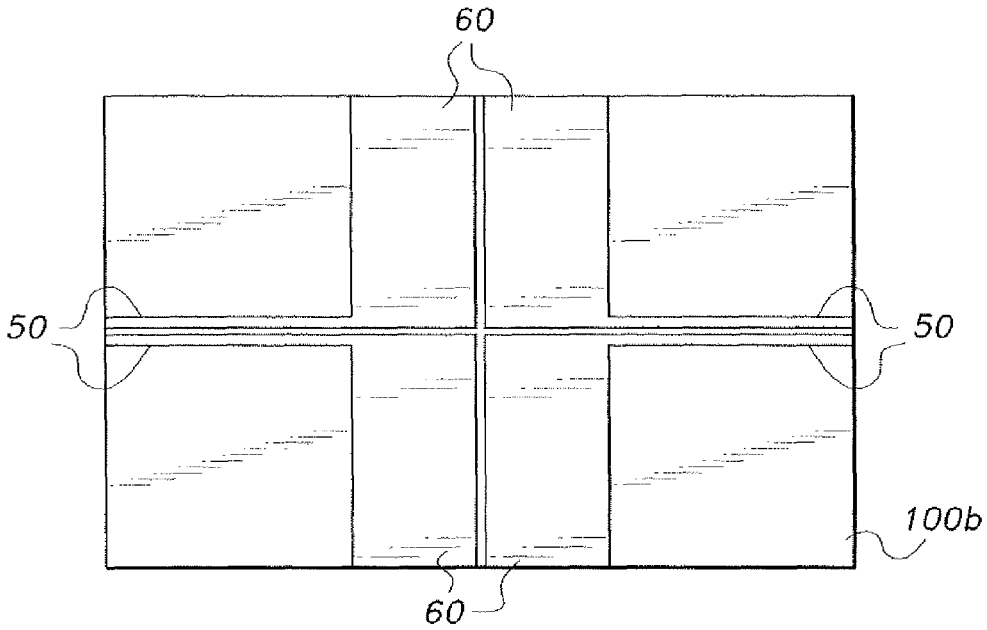
FIG. 5A is a plan view showing the bottom face of another alternative embodiment of an antenna board in a high isolation multiband MIMO antenna system according to the present invention.
Figure 5B:
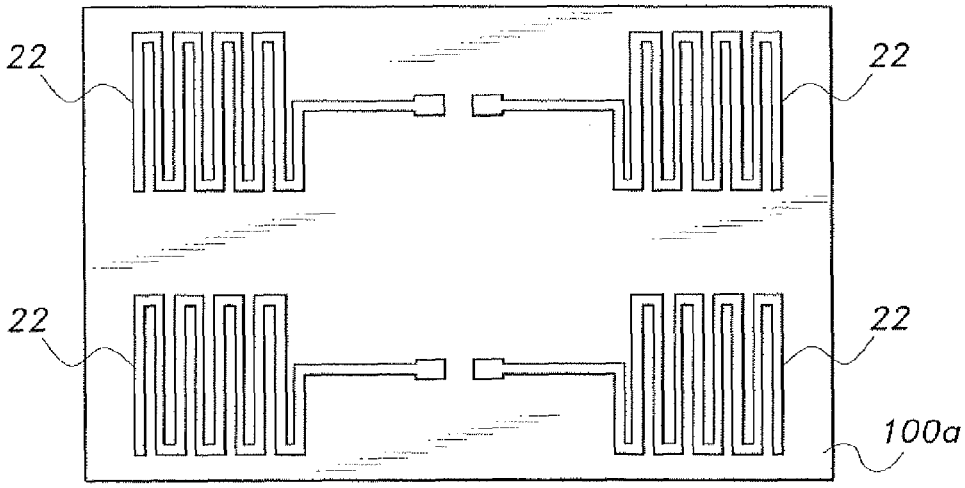
FIG. 5B is a plan view showing the top face of the antenna board of FIG. 4A.
Figure 7:
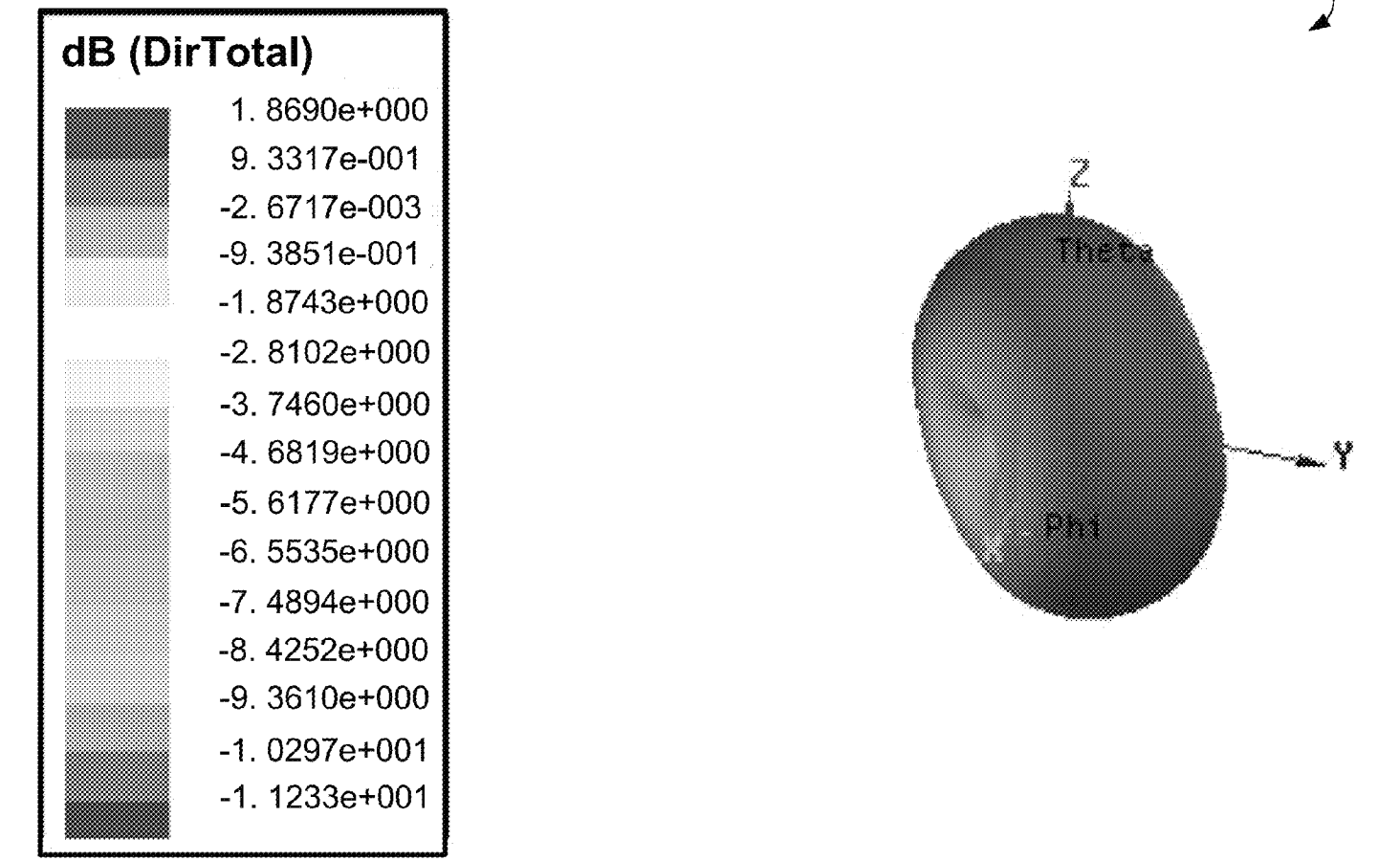
FIG. 7 is a plot showing the directivity in dB for the antenna board of FIGS. 5A-5B.

FIGS. 5A and 5B show an alternative embodiment of an antenna in which all of the radiator/receiver elements are the same type (serpentine elements 22 are shown in the exemplary configuration), thereby resulting in a larger MIMO system. The antenna elements 22 are of the same type, and are placed on a single face 100*a* of the dielectric substrate. Thus, the top face 100*a* has the four antenna elements printed thereon, while the bottom face has the corresponding reference planes, including the main ground planes 60 and the ground arms 50. This can be done for other elements and configurations, e.g., F-shaped elements 23, depending upon the requirements of the application. The antenna system is printed on a substrate area of 50×100 $mm^2$. Plot 700 of FIG. 7 shows the directivity in dB for this antenna element geometry.

Figure 6:
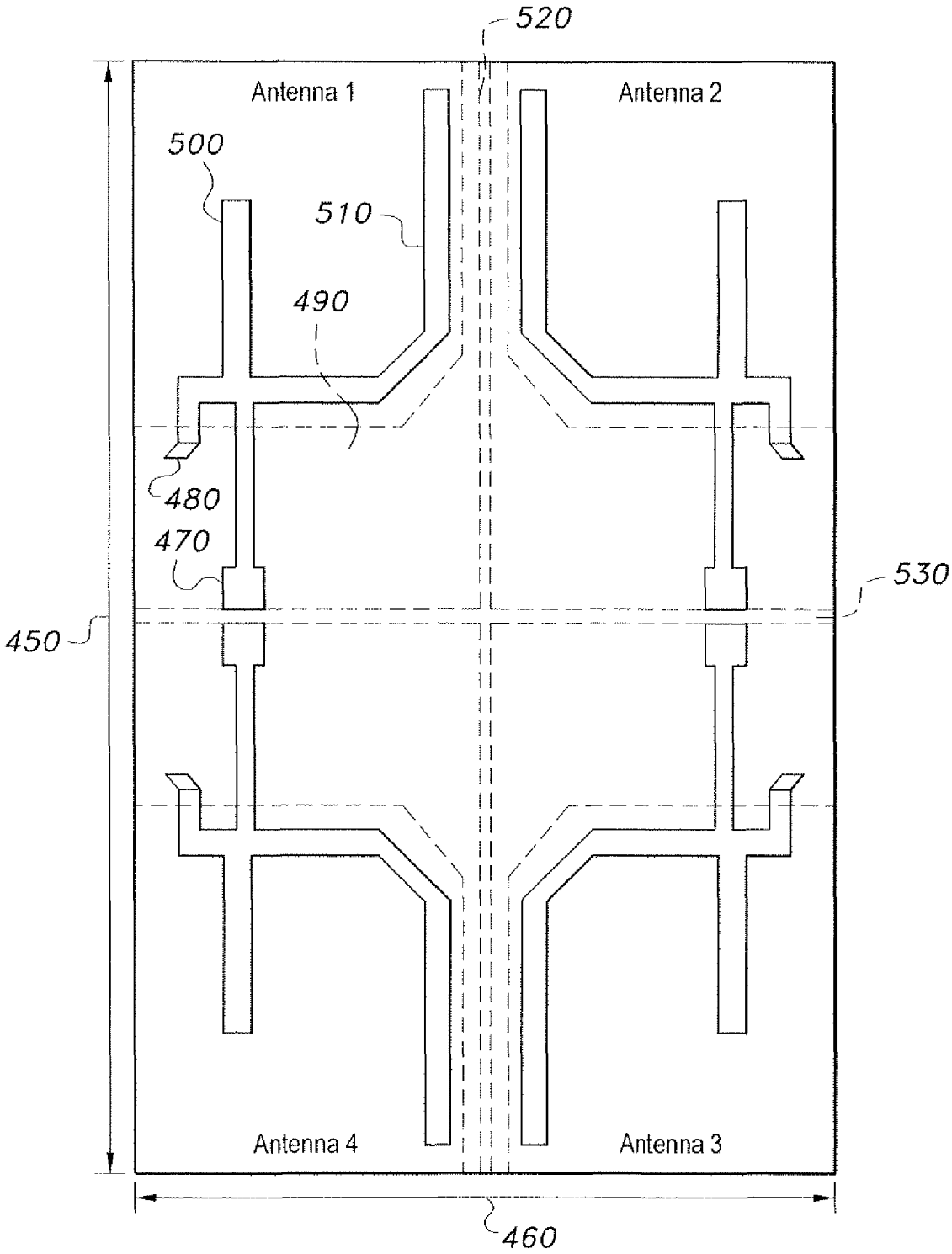
FIG. 6 is a plan view showing the top face of another alternative embodiment of an antenna board in a high isolation multiband MIMO antenna system according to the present invention, the ground plane on the opposite face of the antenna board being shown in phantom.
Figure 8:
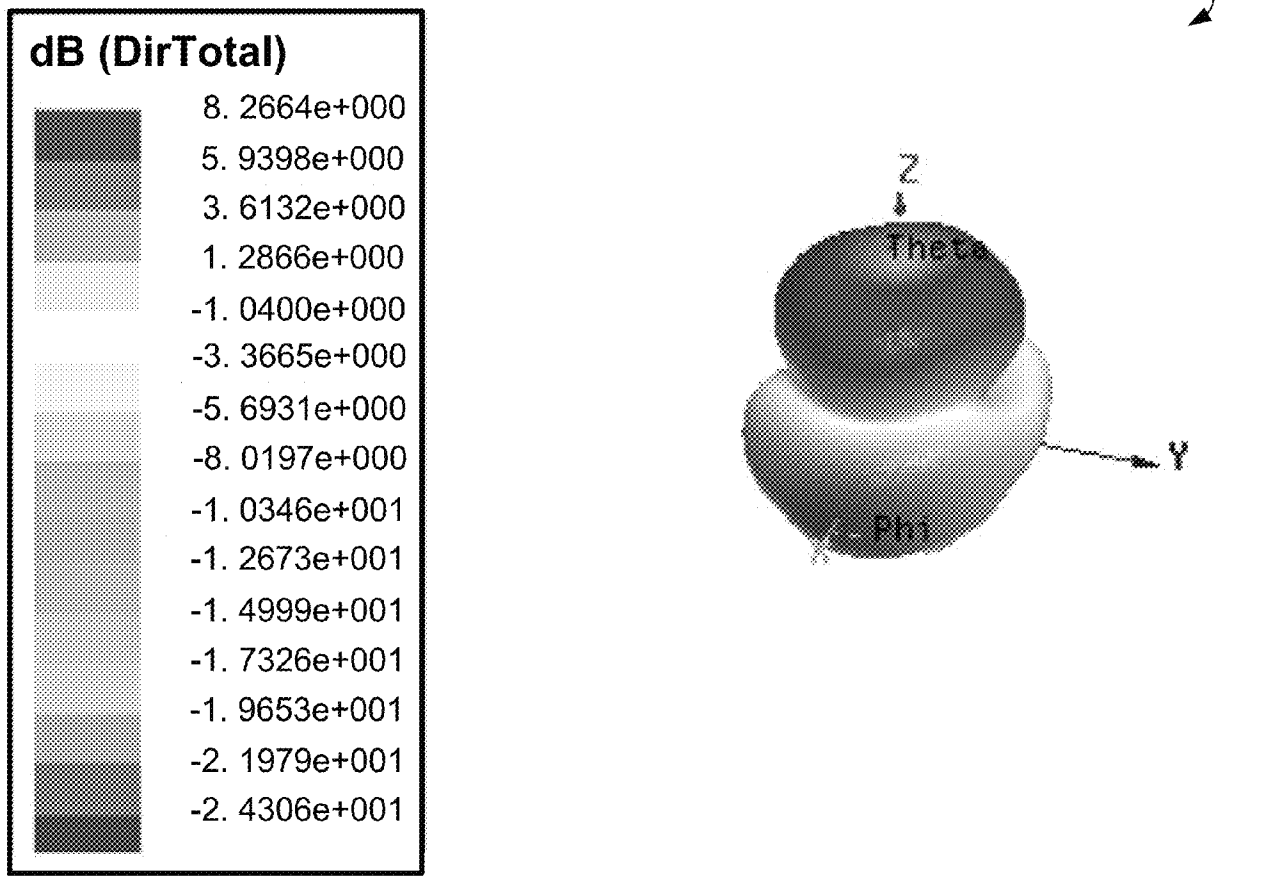
FIG. 8 is a plot showing directivity performance for the antenna element geometry shown in FIG. 6 using the operating band of 780 MHz.
Figure 9:
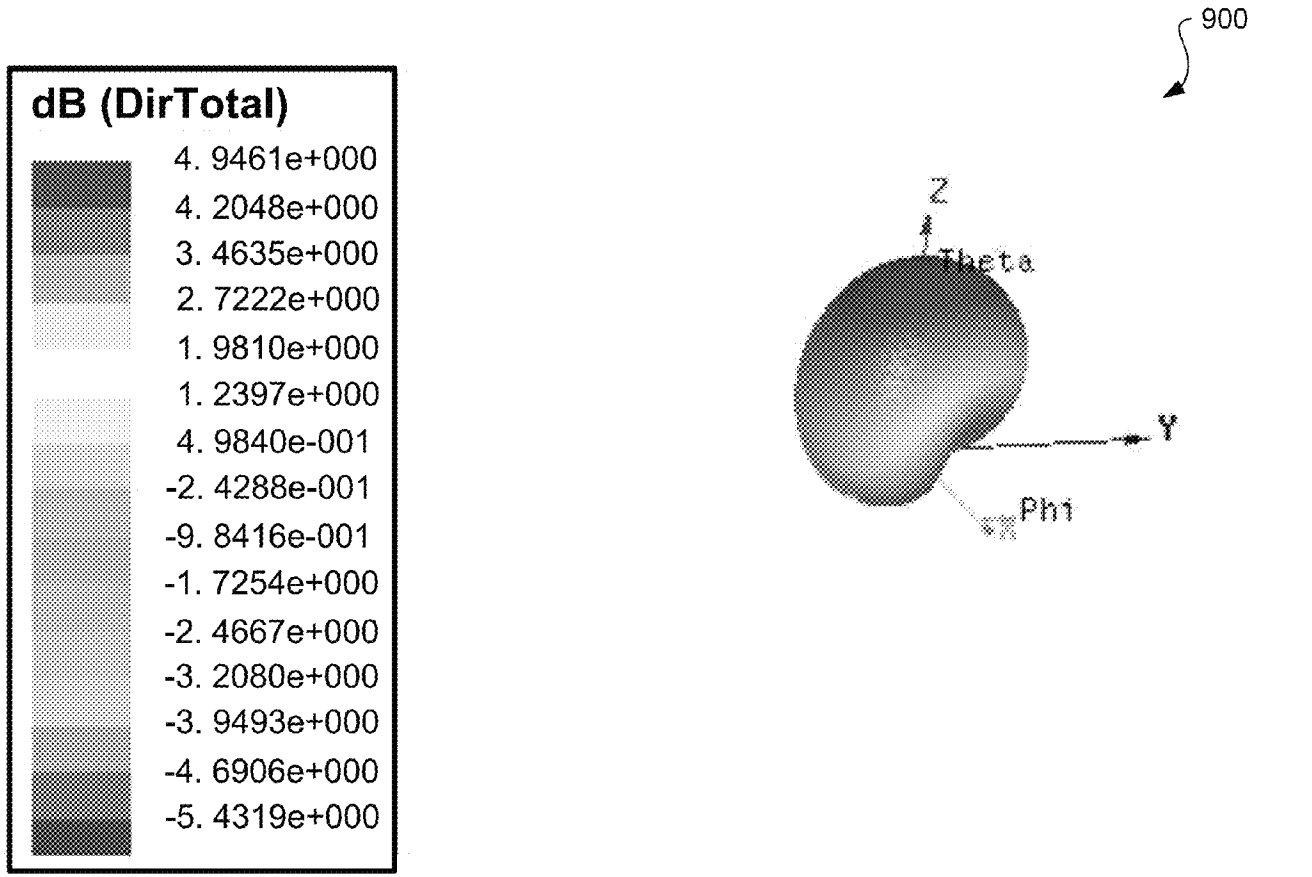
FIG. 9 is a plot showing directivity performance for the antenna element geometry shown in FIG. 6 using the operating band of 2.8 GHz.

FIG. 6 shows a dual band antenna having a different geometry than the above-described antenna geometries. This MEMO antenna system is printed on the top face and the ground planes (shown in phantom) on the bottom layer. The ground planes each have a broad central portion 490 and an elongate portion 520 or strip extending from the central portion medially to the corresponding end of the dielectric substrate. The radiating/receiving elements of the four antennas on the front face of the dielectric substrate each have parallel radiating arms 500 and 510. The variation in the length of the first elongate antenna radiating arm 500 and the second elongate antenna radiating arm 510 changes the resonant frequencies of the single antenna element. The single antenna element comprising members 500 and 510 can cover the lower frequency band of 780 MHz and the highest frequency band of 5.8 GHz (or any other band in this range) in a simple and straightforward manner. Antennas 3 and 4 are mirror images of antennas 1 and 2, each antenna comprising the two main radiating arms 500 and 510, a shortened arm 480 or stub, and feed point 470. The ground plane can be modified according to the aforementioned designs shown in FIGS. 3A through 3F for enhanced isolation performance. The exemplary ground plane splits 530 shown in FIG. 6 are preferable. The length and width of the dielectric substrate are given by 450 and 460, respectively, and they are given by an area of 100×50 $mm^2$. This antenna configuration's directivity performance metrics in dB is shown in plots 800 and 900 of FIGS. 8 and 9 for the operating bands of 780 MHz and 2.8 GHz.

It should be understood that the antenna configurations described herein cover any variation or combination thereof, including variations or combinations of the herein described reference plane isolation enhancement techniques. Moreover, the antennas described herein also apply to any antenna geometry that falls within the range of frequencies and is based on printed elements in a small area for wireless systems with MIMO capability.

It is to be understood that the present invention is not limited to the embodiment described above, but encompasses any and all embodiments within the scope of the following claims.

I claim:

1. A high isolation multiband MIMO antenna system, comprising:

a substantially rectangular planar dielectric substrate having a top face and a bottom face;

a plurality of electrically conductive microstrip antennas disposed on the substantially planar substrate;

at least one ground plane having a substantially L-shaped contour, the at least one ground plane having a substantially rectangular portion and an elongate extension portion, the elongate extension portion extending from the substantially rectangular portion, the substantially rectangular portion and the elongate extension portion being disposed on the substantially planar substrate;

feeding points, for feeding signals, the feeding points being electrically connected to the antennas, wherein said plurality of electrically conductive microstrip antennas comprise at least one F-shaped antenna having an elongate portion having opposed first and second ends, the first end thereof being connected to a corresponding feeding point, and first and second orthogonal portions, said first and second orthogonal portions extending orthogonally to an axis of said elongate portion, said first orthogonal portion extending from the second end of said elongate portion, said second orthogonal portion extending from a central region of said elongate portion, said first orthogonal portion having a length associated therewith which is greater than a length associated with said second orthogonal portion.

2. The high isolation multiband MIMO antenna system according to claim 1, wherein a width-wise edge of said substantially rectangular portion is flush with a length-wise edge of said substrate and a width-wise edge of said elongate extension portion is flush with a width-wise edge of said substrate.

3. The high isolation multiband MIMO antenna system according to claim 1, wherein a width-wise edge of said substantially rectangular portion is parallel to and proximate to a length-wise edge of said substrate.

4. The high isolation multiband MIMO antenna system according to claim 1, wherein a width-wise edge of said elongate extension portion is parallel to and proximate to a width-wise edge of said substrate.

5. The high isolation multiband MIMO antenna system according to claim 1, wherein said substrate has four quadrants, said at least one ground plane comprising four ground planes, each of the quadrants having a corresponding one of the ground planes disposed thereon.

6. The high isolation multiband MIMO antenna system according to claim 1, wherein said at least one ground plane is disposed on the bottom face of said substrate.

7. The high isolation multiband MIMO antenna system according to claim 1, wherein said at least one ground plane is disposed on the top face of said substrate.

8. The high isolation multiband MIMO antenna system according to claim 1, wherein said elongate extension portion has a gap splitting the elongate extension portion into two portions.

9. The high isolation multiband MIMO antenna system according to claim 1, wherein said elongate extension portion has a plurality of gaps splitting the elongate extension portion into multiple portions.

10. The high isolation multiband MIMO antenna system according to claim 1, wherein said at least one F-shaped antenna comprises two F-shaped radiator elements disposed on the top face of said planar substrate in diagonally opposed quadrants.

11. The high isolation multiband MIMO antenna system according to claim 1, wherein said at least one F-shaped antenna comprises one F-shaped radiator element disposed on the top face and one F-shaped radiator element disposed on the bottom surface of said planar substrate.

12. The high isolation multiband MIMO antenna system according to claim 1, wherein said at least one F-shaped antenna comprises four F-shaped elements disposed on the top surface of said planar substrate, one in each quadrant of said substrate.

13. The high isolation multiband MIMO antenna system according to claim 1, wherein said plurality of antennas comprises two serpentine-shaped elements disposed on the top face of said planar substrate in diagonally opposed quadrants, wherein each said serpentine-shaped elements comprises a plurality of coils, each said coil having a width associated therewith which is equal to widths of adjacent ones of said coils.

14. The high isolation multiband MIMO antenna system according to claim 1, wherein said plurality of antennas comprises a first serpentine-shaped element disposed on the top face and a second serpentine-shaped element disposed on the bottom face of said planar substrate, wherein each of said first and second serpentine-shaped elements comprises a plurality of coils, each said coil having a width associated therewith which is equal to widths of adjacent ones of said coils.

15. The high isolation multiband MIMO antenna system according to claim 1, wherein said plurality of antennas comprises a first pair of antennas resonant in a first frequency band and a second pair of antennas resonant in a second frequency band, the first pair of antennas being disposed in diagonally opposed quadrants of said substrate and the second pair of antennas being disposed in a different pair of diagonally opposed quadrants of said substrate.

* * * * *